US005626264A

United States Patent [19]

Florez et al.

[11] Patent Number: 5,626,264

[45] Date of Patent: May 6, 1997

[54] PRECOMPRESSION PUMP SPRAYER

[75] Inventors: Robert L. Florez, Covina; Adonis Spathias, Duarte, both of Calif.

[73] Assignee: Calmar Inc., City of Industry, Calif.

[21] Appl. No.: 694,523

[22] Filed: Aug. 9, 1996

[51] Int. Cl.[6] ..... B65D 88/54

[52] U.S. Cl. ..... 222/321.2; 222/321.9

[58] Field of Search ..... 222/321.2, 321.7, 222/321.9, 383.1, 382, 385.1; 239/333, 463

[56] References Cited

U.S. PATENT DOCUMENTS 4,051,983 10/1977 Anderson .
4,923,094 5/1990 O'Neill .
5,064,105 11/1991 Montaner .
5,190,192 3/1993 Lina et al. ..... 222/321.2
5,560,520 10/1996 Grogen ..... 222/321.2

*Primary Examiner*—Philippe Derakshani
*Attorney, Agent, or Firm*—Watson Cole Stevens Davis, P.L.L.C.

[57] ABSTRACT

A precompression pump sprayer is primed by the provision of a priming ramp for deflecting the lower end of a poppet valve member at the end of the plunger downstroke for cocking the valve member so as to disrupt its sealing action with the discharge valve seat to thereby permit air to be released from the pump chamber through the discharge orifice and to the atmosphere.

7 Claims, 1 Drawing Sheet

PRECOMPRESSION PUMP SPRAYER

BACKGROUND OF THE INVENTION

This invention relates generally to a precompression pump sprayer, and more particularly to a pump chamber priming arrangement for such sprayer.

As known, the manually actuated precompression pump sprayer, otherwise referred to as a pressure build-up pump sprayer, has a reciprocable discharge valve member which opens the discharge at a threshold pump pressure reached during pumping as pump chamber pressure exceeds the force of a return spring. The threshold pressure may not be reached to open the discharge while the pump chamber contains air, which is compressible. Thus, for the precompression pump sprayer to function satisfactorily, the pump chamber must first be primed, i.e., the unwanted air in the chamber must be evacuated and replaced by liquid product to be dispensed.

One approach taken in priming the pump chamber of a precompression sprayer is disclosed in U.S. Pat. No. 4,051,983 wherein a longitudinally extending rib or groove is formed on the inner wall of the bore of the pump housing in which the reciprocable discharge valve operates. A nose of the discharge valve, in the form of a popper valve, is normally seated against a discharge valve seat formed in the discharge passage of a hollow piston stem, under the action of an opposing spring force provided by the piston return spring. At the threshold pressure, the popper valve is forced away from its valve seat to open the discharge, in the known manner.

The popper valve has a seal in sliding sealing engagement with the bore in which the valve reciprocates. As the air in the unprimed pump chamber is compressible, the piston and poppet valve are lowered together upon depressing the plunger. At or near the end of the plunger downstroke, the seal between the poppet seal and the wall of the bore in which the poppet operates is interrupted when the poppet seal is juxtaposed to the rib or groove. The air in the pump chamber, which has now been compressed during the piston downstroke, is evacuated from the pump chamber directly into the container via the dip tube extending into the liquid product in the container. The compressed air flows down the tube by capillary action until product partially fills the pump chamber on each ensuing upstroke which draws liquid product into the pump chamber. As liquid product partially fills the pump chamber, it prevents the remaining volume of air in the pump chamber from being evacuated past the popper seal and into the container. This remaining volume of air must now be purged from the chamber to avoid issuance through the discharge orifice causing an undesirable sputtering and uneven spray.

Another approach taken in priming the pump chamber of a precompression pump sprayer is exemplified by U.S. Pat. No. 5,064,105, wherein one or more small protuberances is formed on the wall of the pump chamber for deforming the piston seal at or near of the end of the piston downstroke permitting unwanted air from the pump chamber to be evacuated into the container via a side port formed in the pump housing.

A still further arrangement provided for priming the pump chamber is disclosed in U.S. Pat. No. 4,923,094 in which the popper valve has a radially outwardly extending base which, at the end of the plunger downstroke, engages a projection on an inner wall of the closure forming a priming step for causing a poppet valve seal to shift away from its confronting wall to open a path for evacuating air from the pump chamber into the container via a container vent.

SUMMARY OF THE INVENTION

It is an object of the present invention to provide a means for priming the pump chamber of a precompression pump sprayer in a simple yet highly efficient and economical manner, such means to be employed in addition to or in lieu of known pump priming means. According to the invention, the air is purged from the pump chamber through the discharge orifice via the poppet seat seal.

In carrying out this objective, a fixed priming ramp which may be molded in the pump housing extends toward an end of the discharge valve member in the path of reciprocation thereof such that, at or near the end of the piston downstroke, the lower end of the valve member is deflected to one side by the ramp. The valve member, in the form of a poppet valve normally coaxial with the piston and cylinder, has a conical nose portion in sealing engagement with a discharge valve seat formed in the piston. When deflected the popper cocks to one side so as to disrupt the discharge valve seal to allow air to escape from the pump chamber to atmosphere via the discharge orifice.

Other objects, advantages and novel features of the invention will become more apparent from the following detailed description of the invention when taken in conjunction with the accompanying drawings.

DETAILED DESCRIPTION OF THE INVENTION

Figure 1:
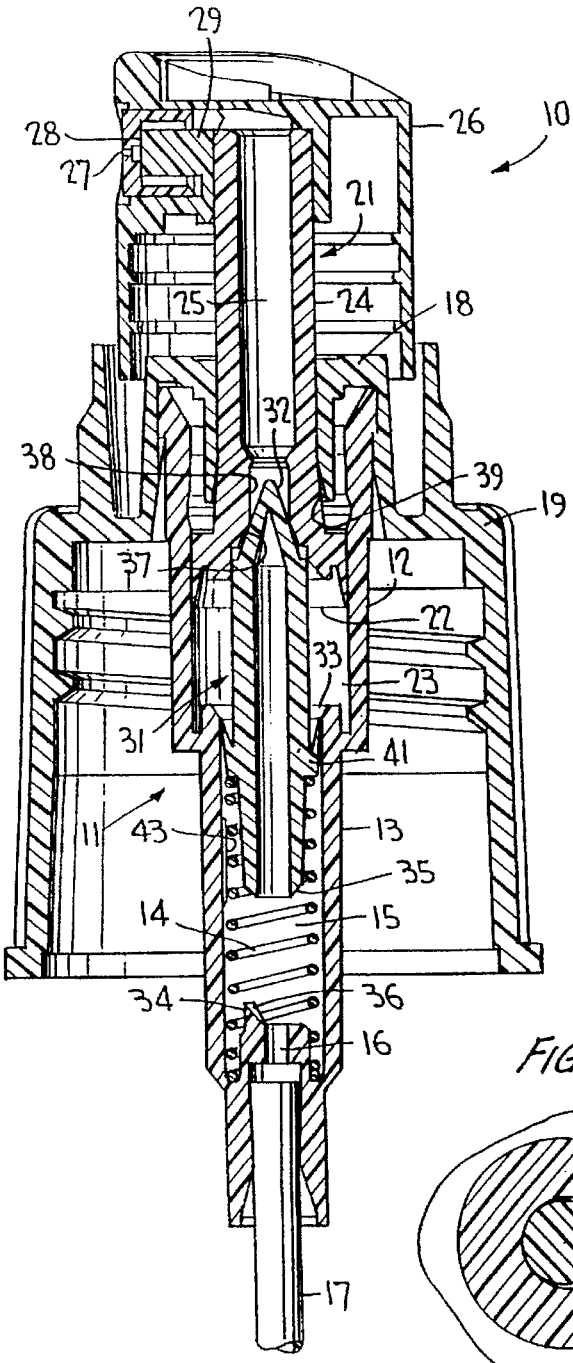
FIG. 1 is a vertical sectional view of the precompression pump sprayer according to the invention shown in its at rest condition.

Turning now to the drawings wherein like reference characters refer to like and corresponding parts throughout the several views, the manually actuated precompression pump sprayer is shown in its at rest condition in FIG. 1 and is generally designated 10. The pump comprises a pump housing 11 in the form of a stepped cylinder having a larger diameter cylindrical section 12 and a smaller diameter cylindrical section 13. The latter forms a housing for piston return spring 14, an inlet passage 15 having an inlet port 16, and supports a dip tube 17 extending into the container (not shown) of liquid product to be dispensed.

Housing 11 is snap-fitted or otherwise securely mounted to a crown portion 18 of closure 19 shown internally threaded for mounting the pump sprayer to the container neck (not shown).

The pump sprayer further comprises a pump piston 21 having a piston seal 22 in sliding sealing engagement with cylindrical section 12 to therewith define a variable volume pump chamber 23. The piston includes a hollow piston stem 24 defining a discharge passage 25, a plunger head 26 being mounted to the stem and facilitating manual operation by the user.

The discharge passage communicates within the head with a discharge orifice 27 of an orifice cup 28 mounted in the head and defining, together with a probe 29 of the head, spin mechanics for imparting a spin or swirl to the liquid product under pressure so as to issue through the orifice in the form of a fine mist spray.

The pump sprayer further includes a discharge valve member 31 which may be a one-piece molded and hollow part having a conical nose portion 32 forming a poppet valve, and having a deformable annular seal 33 between opposing ends. Seal 33, which extends conically upwardly in the form of a chevron, is normally in sliding sealing engagement with the inner wall of cylindrical section 13.

For priming the pump chamber according to the invention, the pump housing has a molded, fixed priming ramp 34 located within the lower end of section 13, extending toward valve member 31 and being located in the path of lower end wall 35 of the valve member. Priming ramp 34 has a wall 36 which slopes slightly in a given direction away from the longitudinal axis of pump housing 11.

A discharge valve seat 37 is formed in discharge passage 25 at the lower end thereof confronting the pump chamber. The discharge valve seat may be in the form of a circular edge defined at the intersection between inner cylindrical wall 38 of the piston stem and conical wall 39 at the inner terminal end of discharge passage 25. The conical wall may be formed at a different slope from that of nose portion 32 to thereby define a discrete circular edge for the discharge valve seat.

Figure 2:
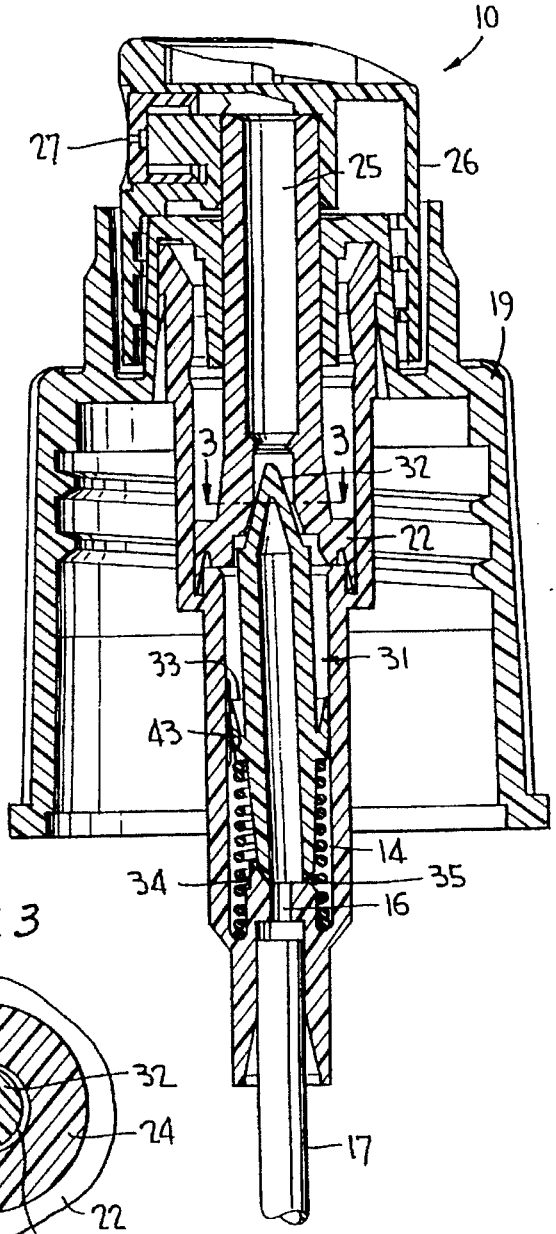
FIG. 2 is a view similar to FIG. 1 showing the piston at a downstroke position when priming the pump.

For priming the pump, plunger head 26 is manually depressed against the counteracting force of return spring 14 which extends between the lower end of cylindrical section 13 and the underside of an annular shoulder 41 formed beneath chevron seal 33. The compressible air within the pump chamber is compressed during the piston downstroke, and valve member 31 is lowered together with the piston to the FIG. 2 position. Since priming ramp 34 is located only to one side of the central axis of the pump housing, with its sloping end wall 36 in alignment with lower end wall 35 of the valve member, wall 35 impacts against sloping end wall 36 in the FIG. 2 position to deflect the lower portion of valve member 31 to the right as viewed in FIG. 2. This deflection causes nose portion 32 of the valve member to deflect to the left as viewed in FIG. 2 about seal 33 acting as a pivot. In other words, valve member 31 is cocked relative to the central axis of the pump housing, such that the axes of the valve member and the pump housing, which were coincident before impacting the priming ramp, are now non-coincident on impact as seen in FIG. 2.

Figure 3:
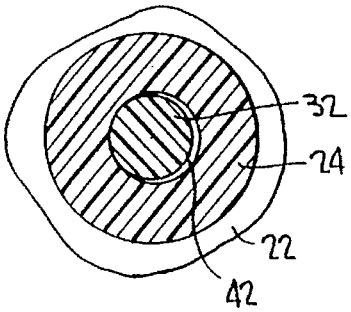
FIG. 3 is a sectional view taken substantially along the line 3—3 of FIG. 2.

This momentary deflection or cocking of the valve member disrupts the seal between nose portion 32 and discharge valve seat 37 and forms a slight open gap 42 (FIG. 3) for momentarily opening the discharge. Thus, any air which had been trapped in the pump chamber is compressed and escapes to atmosphere through open gap 42, discharge passage 25 and discharge orifice 27.

On the ensuing upstroke, as the operator releases downward pressure on the plunger head permitting the piston to return to its FIG. 1 position under the force of the return spring, the poppet is fully reseated, the pump chamber volume expands and suctions product up through the dip tube and through port 16 and passage 15 into pump chamber 23. The liquid, under atmospheric pressure in the container which exceeds the sub-atmosphere pressure in the expanding pump chamber, fills the chamber as it by-passes chevron seal 33 at or beyond the end of the valve member upstroke. The liquid may be inletted to the pump chamber as seal 33 raises slightly out of and/or is forced away from the inner wall of lower cylindrical section 13.

One or two full strokes as aforedescribed should be sufficient to fully prime the pump. Thus, the approach to pump priming according to the invention may be the sole priming provided for the pump sprayer. Otherwise, the present arrangement may be used in addition to known priming means such as that provided for the pump sprayer according to the U.S. Pat. No. 4,051,983.

For example, a protuberance 43, or an equivalent groove, may be provided on the inner wall of section 13 of the housing at a predetermined location. Thus, during priming, when valve member 31 is at or near the end of its downstroke, chevron seal 33 contacts protuberance 43 (or groove) thereby breaking its sealing action with the inner wall of section 13 to permit any air in the pump chamber to be evacuated directly into the container via the dip tube, as described in the U.S. Pat. No. 4,051,983.

Any unwanted air remaining in the pump chamber will, utilizing the priming means of the invention, be evacuated from the pump chamber through gap 42 and the discharge passage to atmosphere via the discharge orifice.

Likewise, if the priming means of the pump is in the form of a protuberance(s) provided on the wall of the pump chamber at the lower end for distorting the piston seal to evacuate the chamber air into the container through a side port, similarly as in the U.S. Pat. No. 5,064,105, the priming means according to the invention may be provided in lieu of or in addition to such known priming means.

From the foregoing it can be seen that a simple yet highly effective approach has been taken in evacuating the unwanted air from the pump chamber of a precompression pump sprayer to atmosphere through the discharge orifice by simply causing the poppet valve member to cock to one side to momentarily disrupt the discharge valve seal forming a slight gap through which the unwanted air releases.

Obviously, many modifications and variations of the present invention are made possible in the light of the above teachings. It is therefore to be understood that within the scope of the appended claims the invention may be practiced otherwise than as specifically described.

What is claimed is:

1. A precompression pump sprayer, comprising a pump housing having a pump cylinder, a pump piston mounted for reciprocation within said cylinder to therewith define a variable volume pump chamber, said piston having a hollow stem defining a discharge passage, a discharge valve seat in said passage confronting said chamber, a discharge valve member mounted for reciprocation within said housing, said valve member comprising a poppet valve in sealing engagement with said valve seat in a discharge closed position, means for reciprocating said piston and said valve member substantially in unison against the bias of a return spring, deflecting means within said housing located out of alignment with a central longitudinal axis of said housing, said deflecting means extending toward said valve member in the path of reciprocation of a lower end of said valve member, said lower end impacting against said deflecting means during the downstroke movement of said piston for deflecting said lower end away from said axis for cocking said popper valve to disrupt the sealing engagement of said poppet valve with said valve seat for expelling entrapped air from said pump chamber through said discharge passage.

2. The pump sprayer according to claim 1, wherein said valve member has an inlet valve seal in engagement with a wall of a reduced diameter section of said housing for controlling an inlet passage to said pump chamber, said housing having means cooperating with said inlet valve seal during the downstroke movement of said piston for expelling the entrapped air from said chamber outwardly of said housing through said inlet passage.

3. The pump sprayer according to claim 1, wherein said deflecting means comprises a priming ramp.

4. The pump sprayer according to claim 2, wherein said cooperating means comprises at least one longitudinal priming rib on said wall of said section.

5. The pump sprayer according to claim 3, wherein said priming ramp has a surface sloping away from said central axis.

6. The pump sprayer according to claim 1, wherein said piston has a piston seal in sliding sealing engagement with said cylinder, said discharge valve seat being located at an end of said discharge passage adjacent said piston seal.

7. The pump sprayer according to claim 1, wherein said discharge valve comprises a poppet valve having a conical nose portion engageable with said discharge valve seat.

* * * * *